US006811468B2

(12) United States Patent
Nobe

(10) Patent No.: US 6,811,468 B2
(45) Date of Patent: Nov. 2, 2004

(54) POLISHING APPARATUS

(75) Inventor: Yoshifumi Nobe, Kagoshima (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 10/686,438

(22) Filed: Oct. 14, 2003

(65) Prior Publication Data

US 2004/0077297 A1 Apr. 22, 2004

Related U.S. Application Data

(62) Division of application No. 09/847,012, filed on Apr. 30, 2001, now Pat. No. 6,656,020.

(30) Foreign Application Priority Data

Jul. 17, 1998 (JP) ..... P10-203944

(51) Int. Cl.[7] ..... B24B 49/04

(52) U.S. Cl. ..... 451/36; 451/41; 451/60; 451/165; 451/287

(58) Field of Search ..... 451/41, 60, 165, 451/287, 288, 398, 458, 910

(56) References Cited

U.S. PATENT DOCUMENTS 5,140,773 A * 8/1992 Miwa et al. ..... 451/41
5,144,771 A * 9/1992 Miwa ..... 451/165
5,449,316 A * 9/1995 Strasbaugh ..... 451/289
5,584,751 A * 12/1996 Kobayashi et al. ..... 451/288
5,688,364 A * 11/1997 Sato ..... 438/693
5,904,615 A * 5/1999 Jeong et al. ..... 451/443
5,913,718 A * 6/1999 Shendon ..... 451/288
5,916,015 A * 6/1999 Natalicio ..... 451/288
6,168,502 B1 * 1/2001 Allman et al. ..... 451/38

* cited by examiner

*Primary Examiner*—Joseph J. Hail, III
*Assistant Examiner*—Anthony Ojini
(74) *Attorney, Agent, or Firm*—Sonnenschein, Nath & Rosenthal LLP

(57) ABSTRACT

A polishing apparatus and a polishing method which can reduce the amount of consumption of the polishing agent and scratches caused on the object to be polished due to an increase of the particle size in the polishing agent. The polishing apparatus has a polishing head which is provided with a polishing agent receiving unit, a holding means for holding an object to be polished in a holding recess, a contact portion which is positioned at the periphery of the holding recess, a feed port for feeding the polishing agent from the polishing agent receiving portion into the closed space, a vibration imparting means for imparting vibration to the polishing agent, and a valve means provided with a valve for opening and closing the feed port.

13 Claims, 9 Drawing Sheets

POLISHING APPARATUS

This application is a division of Ser. No. 09/847,012 filed Apr. 30, 2001, now U.S. Pat. No. 6,656,020.

BACKGROUND OF THE INVENTION

1. Field of the Invention

The present invention relates to a polishing apparatus and a polishing method for flattening a semiconductor substrate or other object to be polished by chemical mechanical polishing.

2. Description of the Related Art

In the process of production of a semiconductor device, for example, a polishing apparatus using chemical mechanical polishing is used for flattening the uneven surface resulting from the multilayer structure of the semiconductor device. An example of this polishing apparatus is shown in FIG. 1 and FIG. 2.

A polishing apparatus 101 shown in FIG. 1 and FIG. 2 is provided with a polishing plate 121 which is rotatably held by a shaft 122 and to a front surface of which a polishing pad 111 is bonded, a polishing head 102 which is rotatably held by a shaft 103 arranged facing the polishing pad 111, and a slurry feed nozzle 131 for feeding a mixture 141 of a polishing agent (slurry) made of a mixture of for example potassium hydroxide (KOH) and silicon dioxide ($SiO_2$) and pure water onto the polishing pad 111.

A polishing head 102 of the polishing apparatus 101, as shown in FIG. 2, is formed with a recessed holder 102*a* for holding a wafer W. The wafer W is held at this holder 102*a* via for example a backing film for holding the wafer W at the holder 102*a*.

The polishing apparatus 101 feeds the mixture 141 of the slurry and the pure water from the slurry feed nozzle 131 onto a center portion of the polishing pad 111 and makes the polishing head 102 and the polishing plate 121 rotate while pressing the wafer W held at the polishing head 102 against the polishing pad 111 with a predetermined pressing force P.

The mixture 141 of the slurry and pure water disperses toward the outer circumference by the rotation of the polishing pad 111 and enters between the polishing pad 111 and the wafer W, whereby the wafer W is flattened by chemical mechanical polishing.

However, in the polishing apparatus 101 having the above configuration, in order to interpose a sufficient amount of slurry between the polishing pad 111 and the wafer W, it is necessary to continuously feed the slurry from the slurry feed nozzle 131, so the amount of consumption of the slurry is increased.

The cost of the slurry is relatively high, so if the amount of consumption of the slurry is increased, there is the disadvantage that the running cost (COO: cost of ownership) of the polishing apparatus 101 is increased.

On the other hand, since the slurry is a mixture of potassium hydroxide (KOH) and silicon dioxide ($SiO_2$), it naturally easily forms hydrogen bonds—resulting in an increase in the particle size of the slurry.

The slurry having the increased particle size is apt to cause polishing scratches (microscratches and macroscratches) on the wafer W during polishing, therefore there was the disadvantage that the percentage of defective wafers W increased and the yield was lowered.

SUMMARY OF THE INVENTION

An object of the present invention is to provide a polishing apparatus using chemical mechanical polishing which is capable of reducing the amount of consumption of the polishing agent and capable of reducing the scratches caused on the object to be polished due to an increase of the particle size in the polishing agent and a polishing method using the same.

According to a first aspect of the present invention, there is provided a polishing apparatus which presses together and makes move relative to each other an object to be polished held at a polishing head and a polishing pad in a state where a polishing agent is interposed between a polishing surface of the object and the polishing pad so as to flatten the polishing surface of the object by chemical mechanical polishing, the polishing head comprising; a polishing agent receiving unit for receiving the polishing agent, a holding means for holding the object to be polished in a holding recess in the polishing head, a contact portion which is positioned at the periphery of the holding recess and is fully contacted to the polishing pad to define a closed space for positioning the polishing agent between the polishing surface of the object to be polished and the polishing pad, a polishing agent feed control means for controlling the feed and the step of the polishing agent from the polishing agent receiving port into the closed space in response to the amount of the polishing agent in the closed space.

Preferably, the polishing agent feed control means comprises a feed port for feeding the polishing agent from the polishing agent receiving portion into the closed space, and a valve means provided with a valve for opening and closing the feed port.

According to a second aspect of the present invention, there is provided a polishing apparatus which presses together and makes move relative to each other a polishing head and a polishing pad in a state where a polishing agent is interposed between a polishing surface of an object to be polished held by the polishing head and the polishing pad so as to flatten the polishing surface of the object by chemical mechanical polishing, the polishing apparatus comprising a vibration imparting means for imparting vibration to the polishing agent.

According to a third aspect of the present invention, there is provided a polishing method in which an object to be polished held at a polishing head and a polishing pad are pressed together and are made move relative to each other in a state where a polishing agent is interposed between a polishing surface of the object polished and the polishing pad so as to flatten the polishing surface by chemical mechanical polishing, the method comprising the steps of defining a closed space between the polishing surface of the object polished and the polishing pad and polishing the polishing surface in a state wherein the polishing agent kept in the closed space.

According to a fourth aspect of the present invention, there is provided a polishing method in which a polishing head and a polishing pad are pressed together and are made move relative to each other in a state where a polishing agent is interposed between a polishing surface of an object to be polished held by the polishing head and the polishing pad so as to flatten the polishing surface by chemical mechanical polishing, the method a step of comprising imparting vibration to the polishing agent.

According to the present invention, when the polishing agent is fed to the polishing agent receiving portion in a state where the contact portion of the polishing head is in full contact with the polishing pad, it is fed into the closed space defined by the contact portion, the polishing pad, and the polishing surface of the object to be polished by the polishing agent feed control means.

When the polishing agent is filled in the closed space, the polishing agent feed control means stops the feed of the polishing agent to give a state where the polishing agent is held in the closed space.

The polishing head and the polishing pad are made to move relative to each other in this state, whereby the polishing surface of the object to be polished is flattened by chemical mechanical polishing.

Further, by applying ultrasonic vibration to the polishing agent, even if the particle size of the polishing agent has increase, the particle size in the polishing agent can be reduced by the ultrasonic vibration, the particle size can equalized, and the formation of macroscratches or microscratches on the polishing surface of the object to be polished can be suppressed.

BRIEF DESCRIPTION OF THE DRAWINGS

The above and other objects and features of the present invention will be more apparent from the following description of preferred embodiments given with reference to the accompanying drawings, wherein.

DESCRIPTION OF THE PREFERRED EMBODIMENTS

Below, preferred embodiments of the present invention will be explained with reference to the drawings.

First Embodiment

Figure 1:
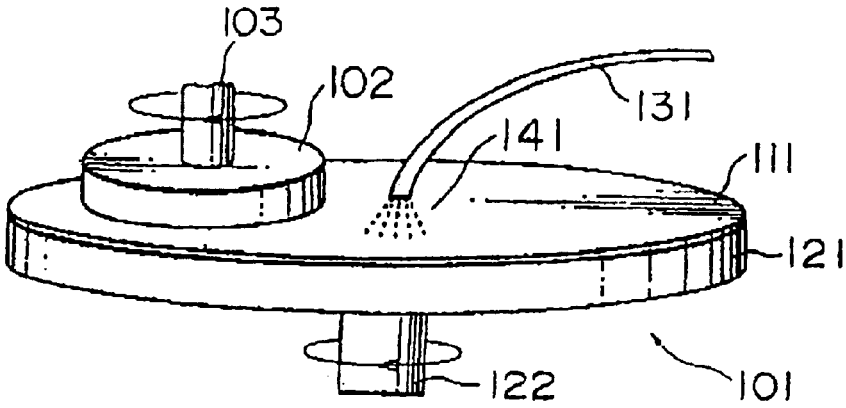
FIG. 1 is a perspective view of an example of the configuration of a polishing apparatus of the related art.
Figure 2:
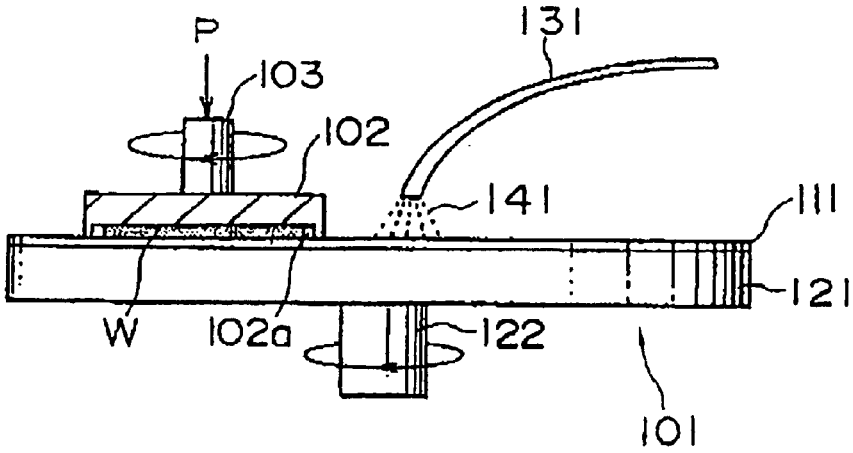
FIG. 2 is a sectional view of the polishing apparatus shown in FIG. 1.
Figure 3:
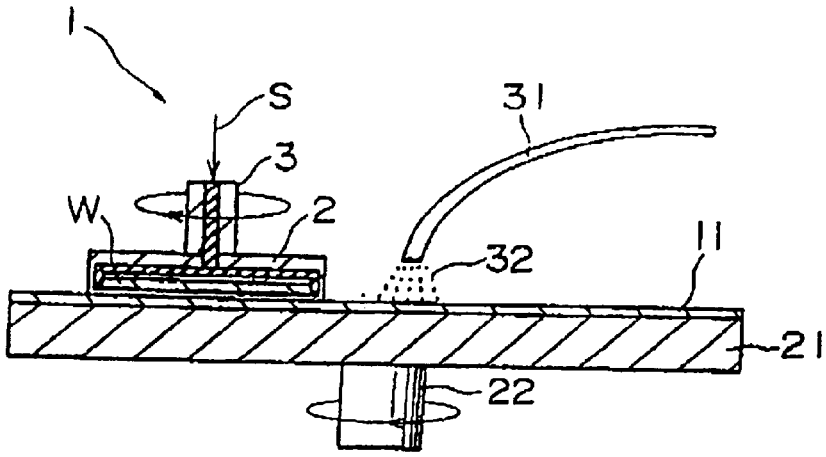
FIG. 3 is a sectional view of a polishing apparatus according to an embodiment of the present invention.
Figure 4:
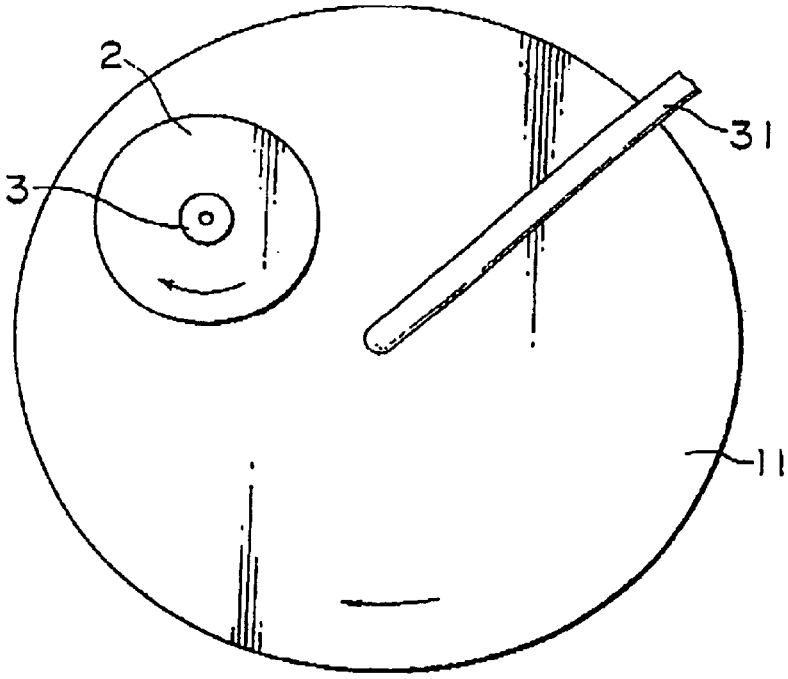
FIG. 4 is a top view of the polishing apparatus shown in FIG. 3.

FIG. 3 and FIG. 4 are views of a polishing apparatus according to a first embodiment of the present invention, in which FIG. 3 is a sectional view and FIG. 4 is a top view. Note that, in the present embodiment, the explanation will be made of a case where a semiconductor wafer W is subjected to the chemical mechanical polishing as the object to be polished by the polishing apparatus.

In FIG. 3 and FIG. 4, a polishing apparatus 1 according to the present embodiment has a polishing head 2 holding the wafer W, a circular polishing plate 21 having a polishing pad 11 bonded to a surface facing the polishing head 2 and having the opposite surface held by a shaft 22, and a pure water feed nozzle 31 for feeding pure water 32 to the center region of the polishing plate 21.

The polishing head 2 is arranged with eccentricity with respect to the polishing pad 11. The polishing head 2 is rotated at a predetermined rotational speed about a shaft portion 3 at a predetermined orientation by a not illustrated drive device. The polishing plate 21 also rotates at a predetermined rotation speed at the predetermined orientation due to the not illustrated polishing apparatus.

Figure 5:
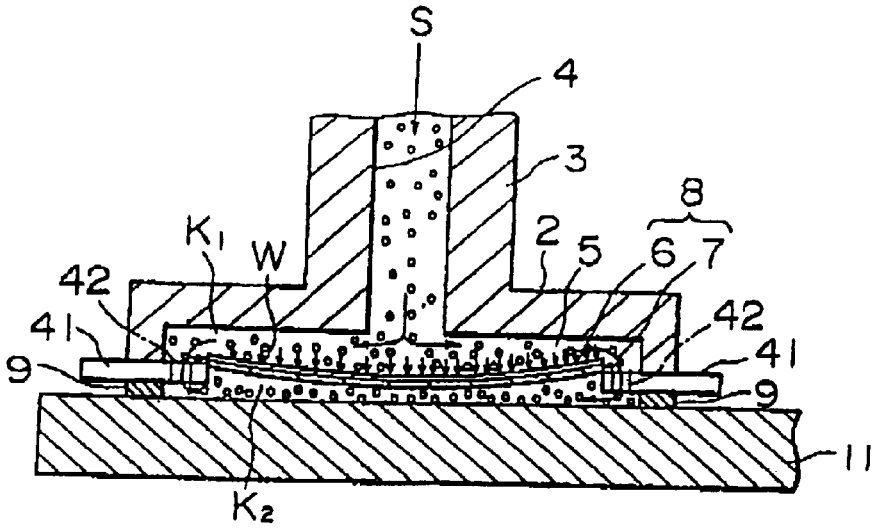
FIG. 5 is an enlarged sectional view of the area around a polishing head of the polishing apparatus shown in FIG. 1.
Figure 6:
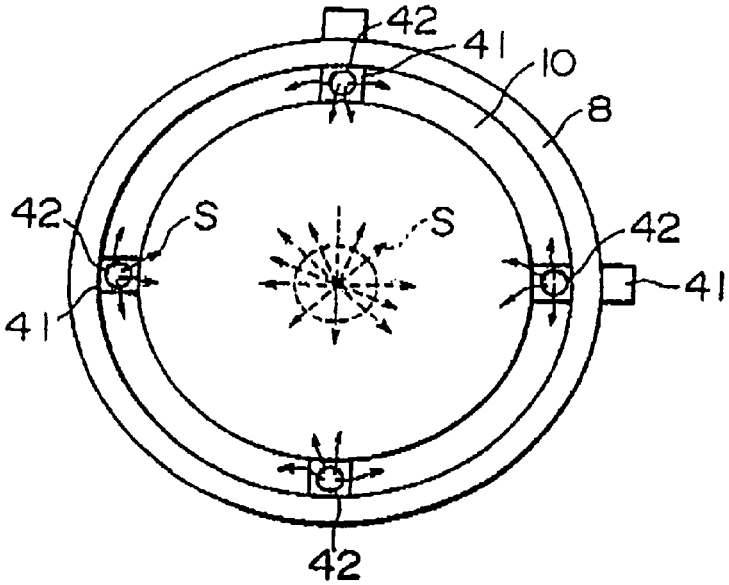
FIG. 6 is a bottom view of the polishing head shown in FIG. 5.

FIG. 5 is an enlarged sectional view of the area around of the polishing head 2 of the polishing apparatus 1 shown in FIG. 3, while FIG. 6 is a bottom view of the polishing head 2 shown in FIG. 5.

As shown in FIG. 5, the shaft portion 3 of the polishing head 2 is formed with a slurry feed pipe 4 for feeding a polishing agent (hereinafter referred to as a "slurry S") into the polishing head 2. At the same time, a holding recess 5 for accommodating and holding the wafer W is formed in the side of the polishing head 2 facing the polishing pad 11.

Note that the slurry S used in the present embodiment is for example a mixture of potassium hydroxide (KOH) and silicon dioxide ($SiO_2$).

The holding recess 5 is provided inside it with a diaphragm member 8 for holding the wafer W and, at the same time, pressing the wafer W toward the polishing pad 1.

The diaphragm member 8 is formed by a material which can be deformed by the pressure of a fluid present at the periphery of the diaphragm member 8 and is provided with a facing surface portion 6 facing a back surface of the wafer W and a fitting surface portion 7 integrally formed with the periphery of the facing surface portion 6 and fitting with the outer circumference of the wafer W.

The diaphragm member 8 is fixed to an inner circumference of an annular holding member 10 shown in FIG. 6 at one end of the fitting surface portion 7. The outer circumference of this holding member 10 is fixed to the inner circumference of the holding recess 5.

The space formed by an inner wall of the holding recess 5, the diaphragm member 8, and the holding member 10 constitutes a slurry feed space K1 into which the slurry S is fed through the slurry feed pipe 4.

As shown in FIG. 6, slurry feed ports 42 which communicate the slurry feed space K1 with the space on the polishing pad 11 side and feed the slurry S into the space on the polishing pad 11 side from the slurry feed space K1 and valve mechanisms 41 having valves for opening or closing these slurry feed ports 42 are provided at four positions at the periphery of the holding member 10.

At the periphery of the holding recess 5, a retainer ring 9 for close contact with the polishing pad 11 is provided.

By the full contact of this retainer ring 9 with the polishing pad 11, a closed space K2 is defined by the polishing pad 11, retainer ring 9, wafer W, and holding member 10.

Figure 7:
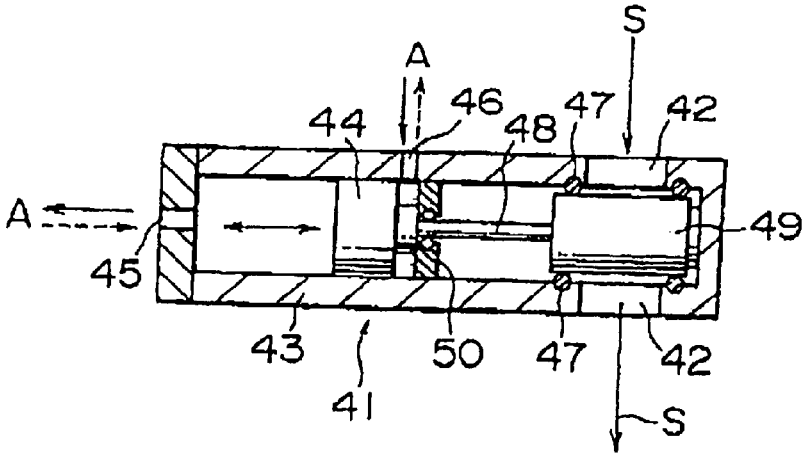
FIG. 7 is a sectional view of an example of the configuration of a valve mechanism.

FIG. 7 is a sectional view of an example of the configuration of a valve mechanism 41.

In FIG. 7, the valve mechanism 41 has a cylinder member 43, a piston member 44 which is fitted in the cylinder member 43 so that it can freely move, and a valve member 49 connected with the piston member 44 via a rod.

The cylinder member 43 has the above slurry feed ports 42 formed at one end portion. O-rings 47 are provided at the peripheries of the slurry feed ports 42.

The interior of the cylinder member 43 is sectioned by a diaphragm member 50. In the chamber at the left side of the figure formed by the diaphragm member 50 is fitted the piston member 44 so that it can freely move.

This piston member 44 can be moved in any direction by appropriately feeding or discharging air A to or from the air feed/discharge ports 45 and 46 formed in the cylinder member 43.

A rod 48 is connected to one end of the piston member 44. The rod 48 extends through the diaphragm 50 to the other chamber. The valve member 49 is fixed to the end portion.

The valve member 49 can fit with the O-ring 42 provided at the periphery of the slurry feed port 42. The valve member 49 opens or closes the slurry feed port 42 by the drive of the piston member 44.

Next, an explanation will be made of an example of the polishing method using the polishing apparatus 1 having the above configuration.

First, in a state where the valve members 49 of the valve mechanisms 41 provided in the polishing head 2 open the feed ports 42, the slurry S is fed into the slurry feed space K1 with the predetermined pressure through the slurry feed ports 42 of the valve mechanisms 41.

The fed slurry S enters between the wafer W and the polishing pad 11 through the feed ports 42 of the valve mechanisms 41 so as to fill the slurry S in the closed space K2.

When a predetermined amount of slurry S is fed into the closed space K2, the valve members 49 of the valve mechanisms 41 are driven to close the feed ports 42.

In this state, the slurry S fed into the slurry feed space K2 presses the facing surface portion 6 and the fitting surface portion 7 of the diaphragm member 8 toward the wafer W in accordance with the feed pressure of the slurry S.

Accordingly, the fitting surface portion 7 of the diaphragm member 8 deforms due to the pressing force from the slurry S, whereby a force for holding the outer circumference of the wafer W is generated.

The facing surface portion 6 of the diaphragm member 8 also deforms due to the pressing force from the slurry S and presses the wafer W toward the polishing pad 11 with a uniform pressing force.

When polishing by rotating the polishing pad 11 and the polishing head 2, the slurry S fed into the closed space K2 is held in the closed space K2 even if the polishing pad 11 and the polishing head 2 move relative to each other.

For this reason, it is not necessary to feed new slurry S between the polishing pad 11 and the wafer W during polishing.

When the polishing is finished, the polishing head 2 moves upward with respect from the polishing pad 11 and pure water is fed from the pure water feed nozzle 13 onto the polishing pad 11 so as to wash the polishing pad 11.

Figure 8B:
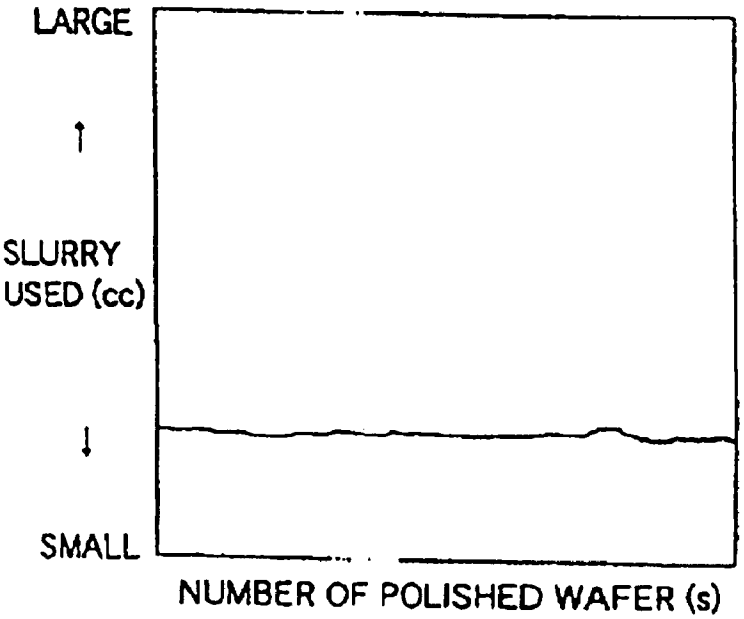
FIGS. 8A and 8B are views of the amounts of slurry consumed in polishing apparatuses.
Figure 8A:
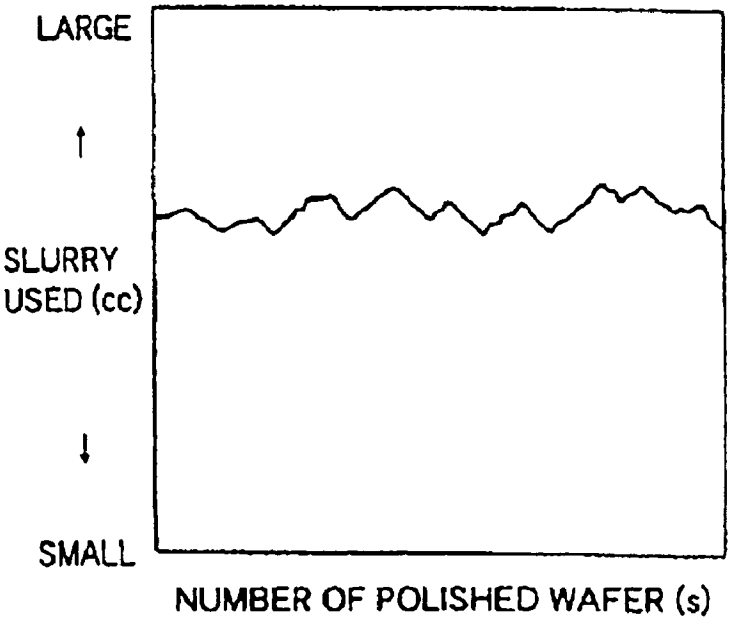

FIG. 8A shows the amount of slurry used when slurry S is continuously fed onto the polishing pad 11 in the polishing apparatus of the related art, while FIG. 8B shows the amount of slurry used in the polishing apparatus 1 according to the present embodiment.

As seen from FIGS. 8A and 8B, in the related art, since the slurry S is continuously fed, the amount of slurry used is large as a whole. Also, the amount of slurry used necessary for ensuring a sufficient amount of slurry between the polishing pad 11 and the wafer W is different for every wafer W.

On the other hand, in the polishing apparatus 1 according to the present embodiment, the amount of slurry used may be kept small as a whole and a sufficient amount of slurry S is stably held between the polishing pad 11 and the wafer W, therefore the amount of slurry required for every wafer W is substantially constant.

As described above, according to the present embodiment, a predetermined amount of slurry S can be maintained between the polishing pad 11 and the wafer W and it is not necessary to continuously feed the slurry S, so the amount of the slurry S used can be reduced.

The present embodiment is structured to hold the slurry S in the closed space K2 and to enable adjustment of the feed pressure of the slurry S fed to the slurry feed space K1 in a state where the valve mechanisms 41 are closed.

Namely, by adjusting the feed pressure of the slurry S, the force of the facing surface portion 6 of the diaphragm member 8 pressing the wafer W against the polishing pad 11 can be adjusted. By suitably adjusting this pressing force, it becomes possible to improve the polishing uniformity of the wafer W.

Note that while the present embodiment was configured so that the diaphragm member 8 holds and presses the wafer W by the feed pressure of the slurry S, the present invention is not limited to this.

For example, it is also possible to separately newly provide a slurry feed portion for feeding the slurry S into the closed space K2 without providing the valve mechanisms 41 for feeding the slurry S into the closed space K2 between the slurry feed space K1 and the closed space K2, provide the valve mechanisms 41 in the feeding route of this slurry feed portion, and feed for example dry air at predetermined pressure into the slurry feed. space K1 so that the diaphragm member 8 holds and presses the wafer W.

By adopting such a configuration, the force of the facing surface portion 6 of the diaphragm member 8 pressing the wafer W against the polishing pad 11 can be controlled independently from the feed pressure of the slurry S.

Second Embodiment

Figure 9:
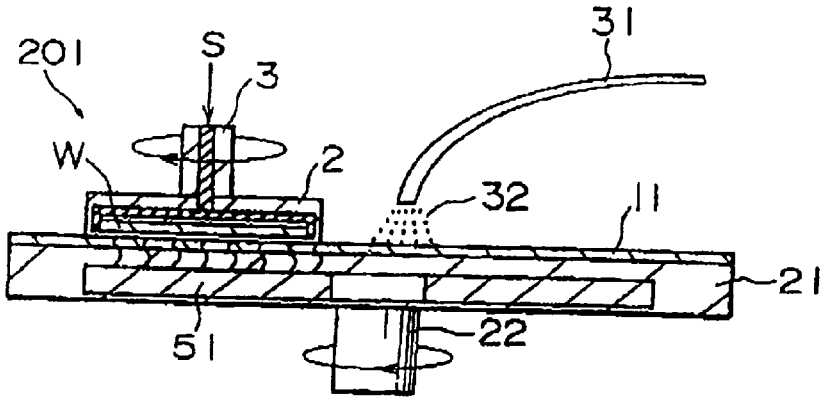
FIG. 9 is a sectional view of a polishing apparatus according to a second embodiment of the present invention.
Figure 10:
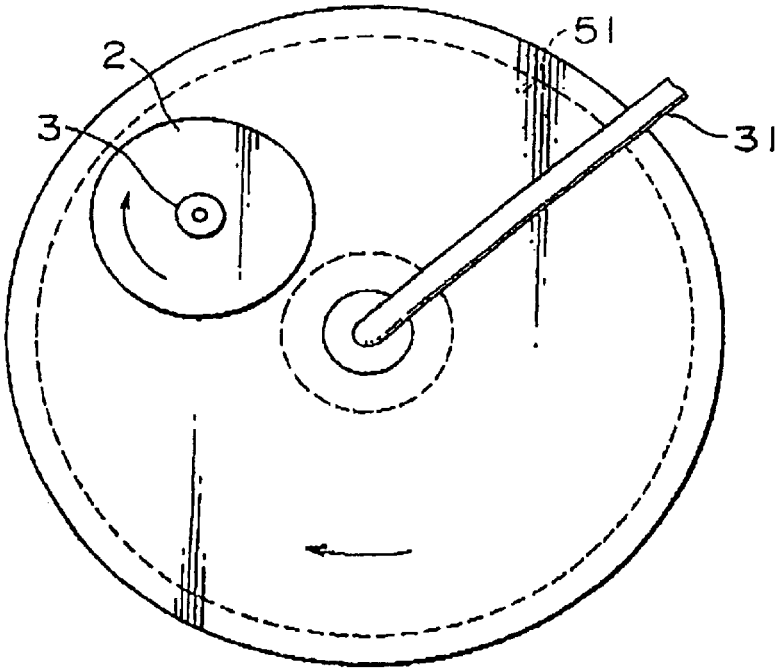
FIG. 10 is a top view of the polishing apparatus shown in FIG. 9.

FIG. 9 and FIG. 10 are explanatory views of a polishing apparatus according to a second embodiment of the present invention, in which FIG. 9 is a sectional view and FIG. 10 is a top view of the polishing apparatus shown in FIG. 9.

A polishing apparatus 201 according to the present embodiment has the same configuration as that of the polishing apparatus 1 according to the first embodiment except an ultrasonic oscillator 51 is built into the polishing plate 21.

In FIG. 9 and FIG. 10, the ultrasonic oscillator 51 is provided in the polishing plate 21 corresponding to the region in which the polishing head 2 moves with respect to the polishing pad 11.

The polishing head 2 rotates while moving in an annular region as shown in FIG. 10 with respect to the polishing pad 11.

The ultrasonic vibration output from the ultrasonic oscillator 51 is propagated to the slurry S held between the wafer W and the polishing pad 11 by using the polishing pad 11 as a propagation medium.

As mentioned above, since the slurry S is a mixture of potassium hydroxide (KOH) and silicon dioxide ($SiO_2$), hydrogen bonds naturally easily occur. The particle size of the slurry S is apt to be increased by this.

When slurry S held between the wafer W and the polishing pad 11 is subjected to the ultrasonic vibration, the slurry S increased in particle size is reduced in size by the action of the ultrasonic vibration and is easily made uniform in particle size.

As a result, the amount of macroscratches and microscratches of the wafer W due to slurry S with an increased particle size is reduced.

Figure 11A:
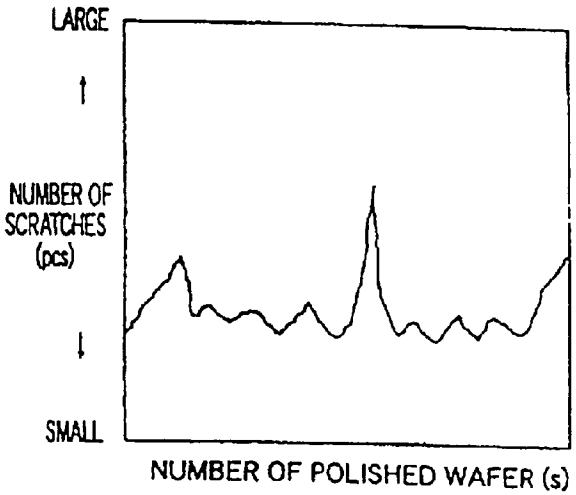
FIGS. 11A and 11B are views of the number of scratches caused on a wafer.
Figure 11B:
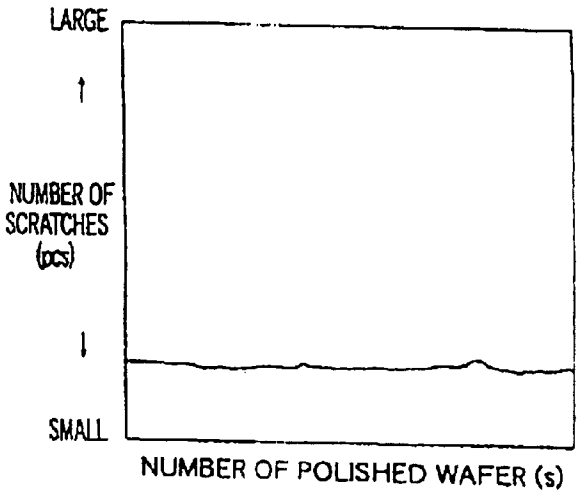

FIG. 11A is a view of the number of scratches caused when polishing a wafer by a polishing apparatus of the related art which does not impart ultrasonic vibration to the slurry S, while FIG. 11B is a view of the number of scratches caused when polishing a wafer by a polishing apparatus 201 according to the present embodiment.

As seen from FIG. 11, in the related art, the number of scratches caused is relatively large. Further, there is also fluctuation in the number of scratches caused for every wafer.

On the other hand, in the present embodiment, the number of scratches caused is reduced and, at the same time, the number of scratches is kept substantially uniform for every wafer.

As described above, according to the present embodiment, therefore, the number of scratches can be reduced and, at the same time, the polishing quality of the wafers W can be stabilized.

Note that while the present embodiment was configured so that an ultrasonic oscillator was built into the polishing plate 21 and ultrasonic vibration was propagated to the slurry S held between the wafer W and the polishing pad 11 by using the polishing pad 11 as a propagation medium, the present invention is not limited to this.

Figure 12:
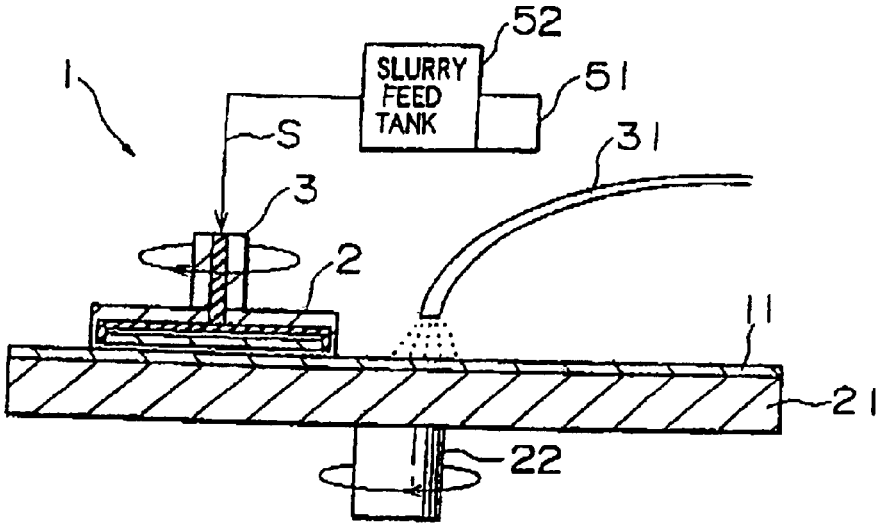
FIG. 12 is a sectional view of a polishing apparatus according to still another embodiment of the present invention.

For example, as shown in FIG. 12, it is also possible to directly attach the ultrasonic oscillator 51 to a slurry feed tank 52 for feeding the slurry S of the polishing apparatus 1 according to the first embodiment and directly impart the ultrasonic vibration to the slurry S held in the slurry feed tank 52.

Figure 13:
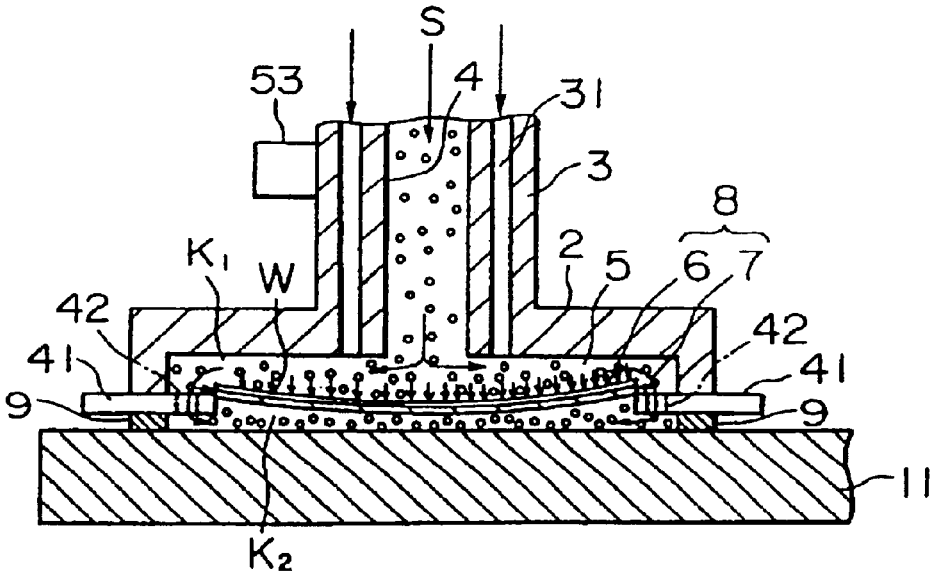
FIG. 13 is a sectional view of a polishing apparatus according to still another embodiment of the present invention.

Further, for example, as shown in FIG. 13, it is also possible to adopt a structure in which the pure water feed nozzle 31 for feeding the pure water is provided at the outer circumference of the slurry feed pipe of the polishing pad 2, an ultrasonic oscillator 53 is provided at the periphery of the pipe for feeding the pure water, and ultrasonic vibration is propagated to the slurry in the slurry feed pipe by using the pure water in the pure water feed pipe as the propagation medium.

Further, the present embodiment was configured so that ultrasonic vibration was imparted to the slurry to make the particle size of the slurry uniform, but the vibration is not limited to ultrasonic vibration and may be any vibration that makes the particle size of the slurry uniform.

Summarizing the advantageous effects of the invention, as described above, according to the polishing apparatus and the polishing method of the present invention, the amount of consumption of the polishing agent can be reduced.

Further, according to the polishing apparatus and the polishing method of the present invention, scratches caused on the object to be polished due to the increase of the particle size in the polishing agent can be reduced.

What is claimed is:

1. A polishing apparatus which presses together and makes move relative to each other an object to be polished held at a polishing head and a polishing pad in a state where a polishing agent is interposed between a polishing surface of the object and the polishing pad so as to flatten the polishing surface of the object by chemical mechanical polishing, the polishing head comprising:

a polishing agent receiving unit for receiving the polishing agent, a holding means for holding the object to be polished in a holding recess in the polishing head, a contact portion which is positioned at the periphery of the holding recess and is fully contacted to the polishing pad to define a closed space for positioning the polishing agent between the polishing surface of the object to be polished and the polishing pad, a polishing agent feed control means for controlling the feed of the polishing agent from the polishing agent receiving port into the closed space in response to the amount of the polishing agent in the closed space.

2. A polishing apparatus as set forth in claim 1, wherein:

the polishing agent feed control means comprises a feed port for feeding the polishing agent from the polishing agent receiving portion into the closed space, and a valve means provided with a valve for opening and closing the feed port.

3. A polishing apparatus as set forth in claim 2, further comprising a vibration imparting means for imparting vibration to the polishing agent.

4. A polishing apparatus as set forth in claim 3, wherein the vibration imparting means comprises an ultrasonic oscillator built into a polishing pad holding member holding the polishing pad and ultrasonic vibration is imparted to the polishing agent held between the polishing pad and the polishing surface of the object.

5. A polishing apparatus as set forth in claim 4, wherein the ultrasonic oscillator built into the polishing pad holding member is arranged corresponding to a predetermined region of movement of the object on the polishing head.

6. A polishing apparatus as set forth in claim 3, wherein the vibration imparting means is provided at a polishing agent feed tank for feeding the polishing agent.

7. A polishing apparatus as set forth in claim 3, wherein said polishing apparatus further comprises a feed pipe for continuously feeding pure water on to the polishing pad, the vibration imparting means is provided at the feed pipe, and the vibration is propagated to the polishing agent on the polishing pad by the pure water fed on to the polishing pad.

8. A polishing apparatus as set forth in claim 7, wherein the polishing pad is driven to rotate about a predetermined shaft, the polishing head is driven to rotate at a position offset from the center of the polishing pad, and the pure water feed pipe feeds pure water to the proximity of the center of the polishing pad.

9. A polishing apparatus as set forth in claim 1, wherein:

the holding means has in a holding recess of the polishing head a holding diaphragm which is provided so as to form with the holding recess a feed space to which a predetermined fluid is supplied, which is formed by a diaphragm which is deformed by a pressure of the fluid, and which is provided with a facing surface portion facing a back surface of the polishing surface of the object to be polished and a fitting surface portion integrally formed with the facing surface portion and fitting with the outer circumference of the object to be polished and the fitting surface portion of the holding diaphragm wafer presses the outer circumference of the object to be polished by the pressure of the fluid fed to the feed space to hold the object to be polished.

10. A polishing apparatus as set forth in claim 9, wherein the facing surface portion of the holding diaphragm presses the back surface of the polishing surface of the object to be polished held by the fitting surface portion against the polishing pad by the pressure of the fluid fed to the feed space.

11. A polishing apparatus as set forth in claim 10, wherein the fluid comprises the polishing agent.

12. A polishing apparatus as set forth in claim 1, wherein the polishing agent contains a mixture of potassium hydroxide and silicon dioxide.

13. A polishing apparatus as set forth in claim 1, wherein the object to be polished is a semiconductor substrate.

* * * * *